United States Patent [19]

Eidenböck

[11] Patent Number: 4,495,908

[45] Date of Patent: Jan. 29, 1985

[54] INTERNAL COMBUSTION ENGINE WITH IMPROVED SOUND-INSULATION

[75] Inventor: Thomas Eidenböck, Graz, Austria

[73] Assignee: Avl Gesellschaft fur Verbrennungskraftmaschinen und Messtechnik m.b.H., Graz, Austria

[21] Appl. No.: 537,519

[22] Filed: Sep. 30, 1983

[30] Foreign Application Priority Data

Dec. 3, 1982 [AT] Austria ..... 4418/82

[51] Int. Cl.[3] ..... F02B 77/00

[52] U.S. Cl. ..... 123/195 C; 123/195 S; 123/198 E

[58] Field of Search ..... 123/195 A, 195 C, 195 S, 123/195 H, 198 E

[56] References Cited

U.S. PATENT DOCUMENTS

| | | | |
|---|---|---|---|
| 4,267,805 | 5/1981 | Schmuck | 123/198 E |
| 4,377,993 | 3/1983 | List | 123/195 C |
| 4,428,338 | 1/1984 | Skatsche et al. | 123/195 C |

*Primary Examiner*—Craig R. Feinberg
*Assistant Examiner*—David A. Okonsky
*Attorney, Agent, or Firm*—Watson, Cole, Grindle & Watson

[57] ABSTRACT

An internal combustion engine has an engine unit support, comprising such sound-carrying parts as cylinders, cylinder head, pistons, piston rods, crankshaft bearings, and crankshaft, which is provided, at least at the output end thereof with a bracket of at least two arms which bracket is attached to the crankshaft bearing seats and is provided with at least one sound-insulating element on each end. At least some of the sound-insulating elements carry inner sleeves acting as setting elements whose axial position relative to outer sleeves thereof may be adjusted even after the engine unit support has been mounted in the crankcase. In this simple manner the sound-insulating elements may be provided with any desired pre-stressing, which will help to achieve optimum sound-insulation.

5 Claims, 8 Drawing Figures

INTERNAL COMBUSTION ENGINE WITH IMPROVED SOUND-INSULATION

BACKGROUND OF THE INVENTION

This invention relates to an internal combustion engine whose engine unit support, comprising such sound-generating parts as cylinders, cylinder head, pistons, piston rods, crankschaft bearings, crankshaft, is attached to the crankcase by means of several sound-insulating and force-transmitting elements protecting the crankcase against structure-borne sound and located outside of the oil-wetted area of the crankcase, the axes of these substantially hollow cylindrical sound-insulating elements being parallel to the axis of the crankshaft, and which is provided with a multi-arm bracket, preferably a two-armed lever, at least at the output end of the engine unit support for the purpose of reducing the relative movements of the support to a swinging movement around the crankshaft axis. This lever is attached to the crankshaft bearing seats and provided with at least one sound-insulating element at each end. The bracket arms and the sound-insulating elements are positioned symmetrically to the crankshaft axis, and the position of the sound-insulating elements fastened to the bracket arms relative to the crankcase can be adjusted by means of setting elements in such a way as to make the pre-stressing of the sound-insulating elements completely independent of this position.

DESCRIPTION OF THE PRIOR ART

This arrangement which is described, e.g., in U.S. Pat. No. 4,428,338 permits an improvement of the method of mounting the engine unit support such that the relative movements possible between the crankshaft and the crankcase are reduced in a simple way while maintaining the favorable location of the sound-insulating and force-transmitting elements between engine unit support and crankcase outside of the oil-wetted area of the crankcase. The particular arrangement of the sound-insulating elements relative to the crankshaft axis will reduce the relative movements of the engine unit support which are made possible by the flexibility of the sound-insulating elements, and will limit them to a swinging movement around the crankshaft axis itself, thereby eliminating the need of separate compensating elements or stops at the output end of the engine unit support.

Experience has frequently shown that in otherwise identical combustion engines whose engine unit support is suspended in the crankcase by means of sound-insulating elements, the degree of sound-insulation possible largely depends on manufacturing and mounting tolerances, since—due to the sound-insulating elements being attached to the engine unit support and to the crankcase—these tolerances will directly lead to differences in the pre-stressing of the individual flexible elements, which will result in different vibration and damping characteristics. For this reason one of the variants according to U.S. Pat. No. 4,428,338 already provided that the position of the sound-insulating elements attached to the bracket arms relative to the crankcase be made adjustable by means of setting elements in such a way as to make the pre-stressing of the sound-insulating elements independent of this position. In this previous proposal these setting elements were configured as washers of a graded thickness which were to be used for adjusting the position of the sound-insulating elements relative to the crankcase and to the engine unit support; since the correct adjustment of the sound-insulating elements can be told only when the engine unit support is being mounted in the crankcase, however, the use of such washers has the disadvantage that the mounting process must be repeated at least once before the correct number and thickness of washers for all sound-insulated fastenings is found.

SUMMARY OF THE INVENTION

It is an object of the present invention to avoid the above disadvantages of the previous proposal, and to permit adjustment of the relative position of the sound-insulating elements so as to protect them from unwanted stresses when the engine unit support is being mounted in the crankcase.

According to the present invention this is achieved by providing at least some of the sound-insulating elements with inner sleeves as setting elements whose axial position relative to the outer sleeves may be adjusted when the engine unit support has been mounted in the crankcase. In this simple manner the sound-insulating elements may be kept stress-free or may be given any desired pre-stress without having to disassemble the connecting elements between engine unit support, or rather bracket, and crankcase, which will greatly enhance the quality of sound-insulation achievable.

In an enhanced version of the present invention the inner sleeve of the sound-insulating element carries an intermediary sleeve which may be axially moved and adjusted relative to the exterior of the inner sleeve, and which serves as the inner support of the flexible element used for sound-insulation, and which—just as the outer sleeve—is attached to the flexible element, e.g., by vulcanization. As suggested in another variant of the invention, it is of advantage in this context, if the inner sleeve of the sound-insulating element carries an external thread which may engage the intermediary sleeve. This is a very simple method of adjusting the relative axial position between inner and outer sleeve, and will greatly facilitate assembly.

In another variant of this invention radial grooves may be provided on corresponding front faces of inner and intermediary sleeves, for inserting a turning tool or fixing a desired relative position between the two sleeves. Although this position—once it has been established—might also be fixed by means of a dent, it is preferable, e.g., if parts of the intermediary or inner sleeve are pressed into the grooves of their respective counterparts, which are provided for the turning tool, or if locknuts or similar fixing elements are used.

DESCRIPTION OF THE DRAWING

The invention will now be further illustrated, by way of example, with reference to the accompanying drawings in which.

DESCRIPTION OF THE PREFERRED EMBODIMENTS

Figure 1:
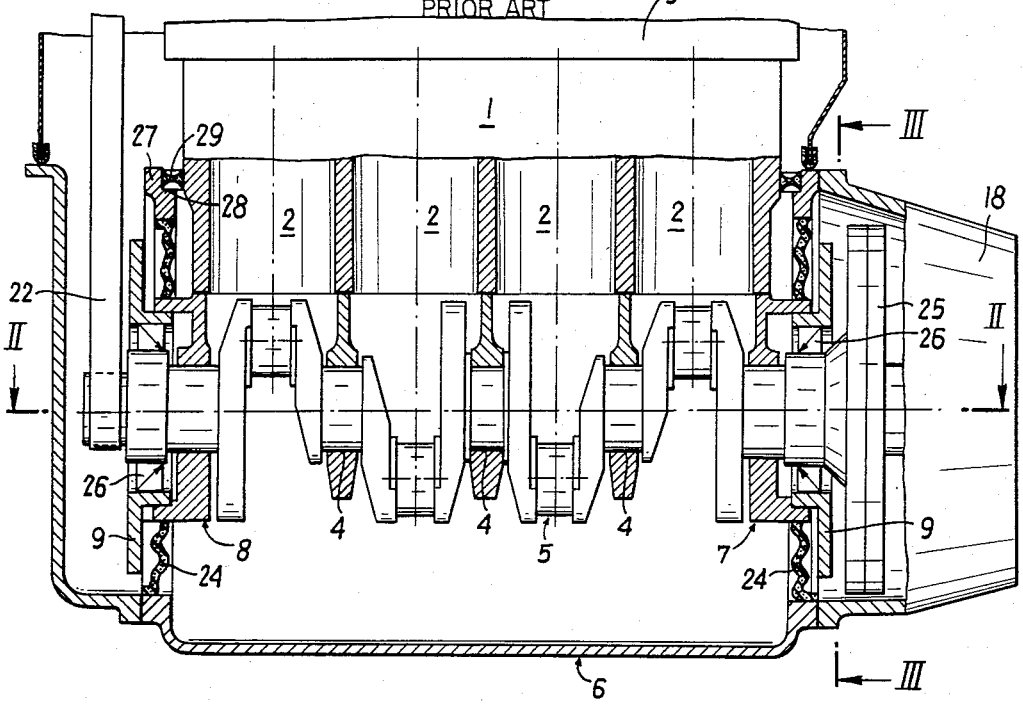
FIG. 1 PRIOR ART
FIG. 1 is a schematical view of a longitudinal section through an internal combustion engine according to the state of the art
Figure 2:
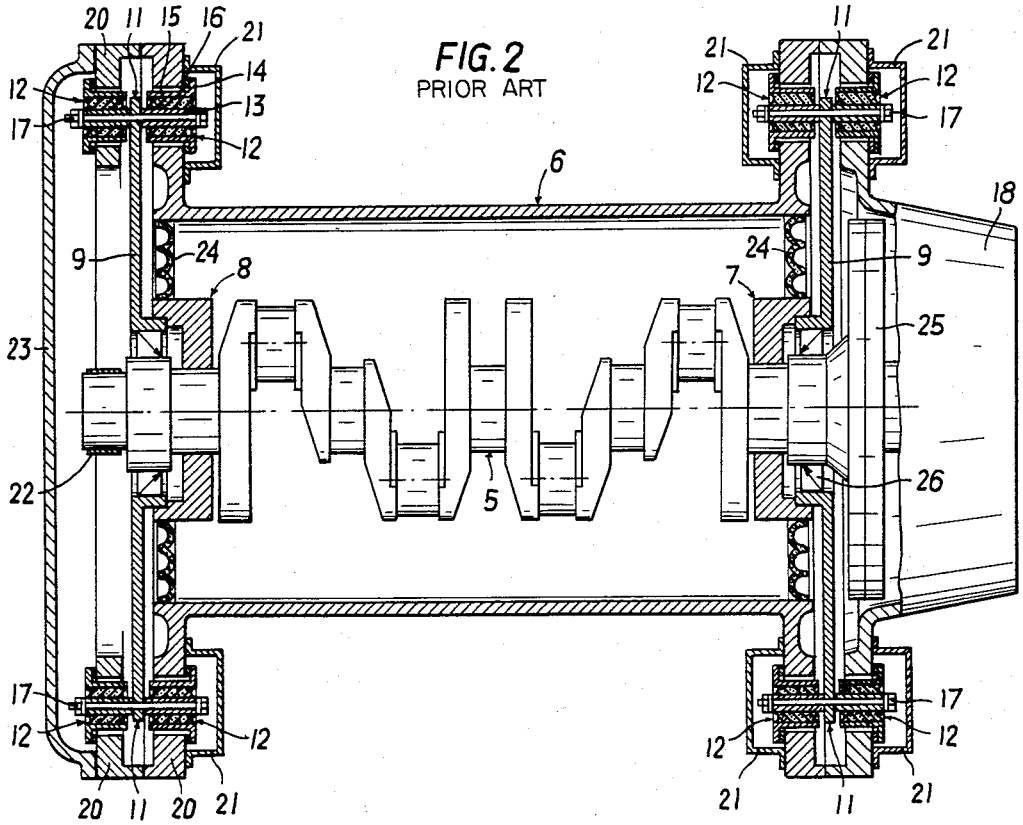
FIG. 2 PRIOR ART
FIG. 2 is a section along line II—II in FIG. 1.
Figure 3:
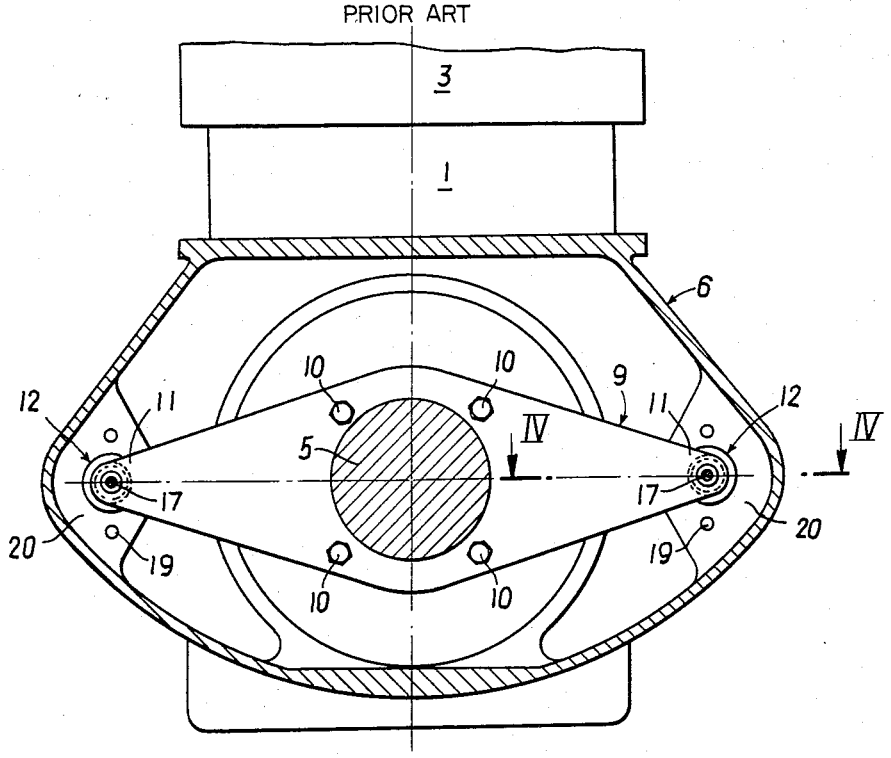
FIG. 3 PRIOR ART
FIG. 3 is a section along line III—III in FIG. 1.

The internal combustion engine illustrated in FIGS. 1 to 3 is provided with an engine unit support 1 comprising such sound-carrying components as cylinders 2, cylinder head 3, pistons and piston rods (not shown here), crankshaft bearings 4 and crankshaft 5, which is attached to the crankcase 6 by means of sound-insulating elements; as a consequence, the crankcase 6 itself is sound-insulated as well. For this purpose, the engine unit support 1 is supplied both at the output end 7 and at the opposite end 8 with a two-armed bracket 9 which is fastened with fasteners 10 (FIG. 3) to the outermost bearing seats of the crankshaft bearings 4 or to the engine unit support 1 in the vicinity of the outermost crankshaft bearing seats, and which bears two sound-insulating elements 12 on each of its ends 11. In the variant illustrated, the sound-insulating elements 12 consist of an inner cylinder or sleeve 13, of an outer sleeve 15 provided with a mounting flange 14, and of a flexible material 16 filling the space between the sleeves, which prevents the propagation of structure-borne sound between the inner sleeve 13 and the outer sleeve 15 and any further parts connected to them.

The sound-insulating elements 12 are fastened to the brackets 9 with through-bolts 17 which will press the inner sleeves 13 of two elements opposing each other against the brackets 9. The outer sleeves 15 are attached to the crankcase 6 or rather to the flywheel housing 18 connected to the crankcase by means of mounting flanges 14, which are fastened to special lugs 20 on the crankcase or flywheel housing with through bolts 19. In order to prevent the radiation of sound via the inner sleeves 13 and through bolts 17 connected to the sound-carrying engine unit support, the sound-insulating elements 12 are provided with covers 21; on the side of the engine unit support bearing the drive 22 for an overhead camshaft (not shown here), both the sound-insulating elements 12 and the camshaft drive 22 are covered by a cover 23.

At ends 7 and 8 the engine unit support 1 is provided with flexible oil seals 24 sealing the interior or the crankcase 6 against the loss of oil; as they do not bear any structural load they are of a material soft enough to inhibit the transmission of structure-borne sound from the engine unit support 1 to the crankcase 6. The crankshaft itself is sealed against the loss of oil by means of rotary shaft seals 26 both at the side of the flywheel 25 and at that of the camshaft drive 22. FIG. 1 also shows the seal at the upper edge 27 of the crankcase 6 against the engine unit support 1. For this purpose a flexible sealing element 29 (schematically indicated in this drawing) is inserted into a groove 28 running along the entire crankcase—again without any load-bearing function.

The sound-insulating elements 12 are thus positioned outside of the crankcase interior, and are therefore not exposed to the spray of hot lubricant, which greatly extends the life of these elements.

As shown in FIGS. 2 and 3, the sound-insulating elements 12 which are shaped as hollow cylinders, are positioned such that their axes run parallel to the axis of the crankshaft 5. In view of a marked preference of the modern car designer for a transverse position of the engine relative to the vehicle's longitudinal axis, this positioning is of advantage as it permits the sound-insulating elements to absorb the high accelerations required during the so-called "crash tests" with small radial deformations only.

Furthermore, it is of particular advantage that the arrangement of the sound-insulating elements 12 is symmetrical with respect to the axis of the crankshaft 5, since with this arrangement the relative movements between the engine unit support 1 and the crankcase 6, which are made possible by the flexibility of the sound-insulating elements 12, are reduced to a swinging movement around the axis of the crankshaft 5, thereby eliminating the necessity of stops or flexible linkages at the output end of the crankshaft, which would otherwise be required for restricting the movements of the crankshaft relative to other output elements not shown in this drawing.

Another advantage of the internal combustion engine shown in this drawing is that the crankcase may be of the one-piece die-cast type due to the particular system of mounting of the engine unit support.

As a variant of the example presented here, a multi-armed bracket would also be conceivable, with at least one sound-insulating element at each of its ends for attaching the engine unit support to the crankcase.

The detail of an embodiment of the invention presented in FIG. 4 again shows the sound-insulating elements 12 which are fastened at the ends 11 of bracket 9 via the inner sleeves 13,13' and through bolts 17. In this variant the outer sleeves 15 are fastened by pressing them into bores 30 of the lugs 20 of the crankcase 6 and the flywheel housing 18; other possibilities of attaching the outer sleeves 15 are also conceivable.

Figure 4:
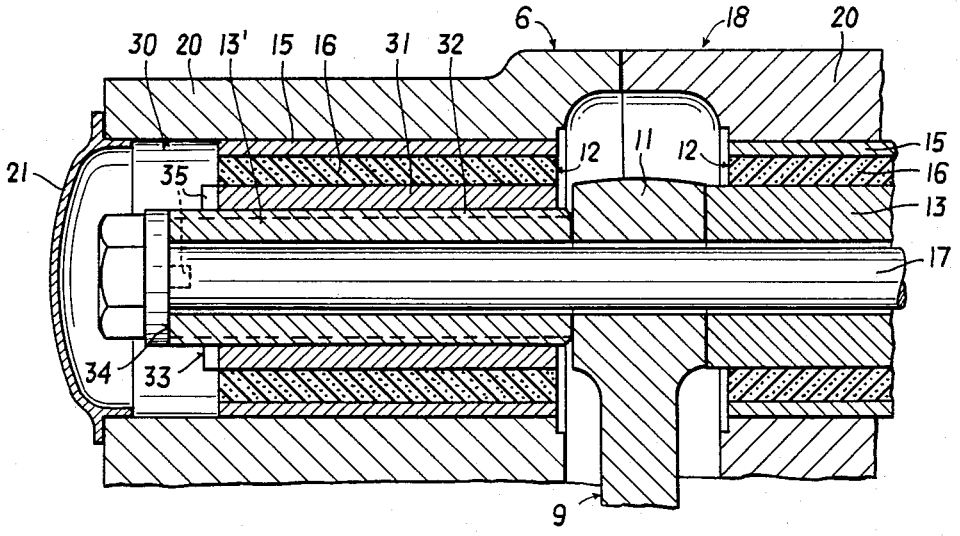
FIG. 4 presents a section along line IV—IV of FIG. 3 on an enlarged scale, designed according to the present invention.

In order to prevent manufacturing and mounting tolerances of the combustion engine from causing different axial pre-stresses in the sound-insulating elements 12 which are pressed against the bracket 9 by means of the through bolts 17, the left one of the two sound-insulating elements 12 of FIG. 4 is provided with an inner sleeve 13' whose axial position relative to the outer sleeve 15 is made adjustable. For this purpose the inner sleeve 13' may be axially moved and fixed against an intermediary sleeve 31 which forms the inner support of the flexible element 16 used for the purpose of sound-insulation, and which—just as the outer sleeve 15—is attached to the flexible element 16, e.g., by vulcanization. In order to ensure axial movability between the inner sleeve 13' and the intermediary sleeve 31 in a simple way, the intermediary sleeve is provided with an internal thread 32 for receiving the inner sleeve 13'. The corresponding front faces 33,34 of the inner sleeve 13' and the intermediary sleeve 31, are provided with radial grooves 35 (for a better view, see FIGS. 6 and 8), permitting the insertion of a turning tool for assembly purposes, and fixing a desired relative position between the two sleeves.

Figure 5:
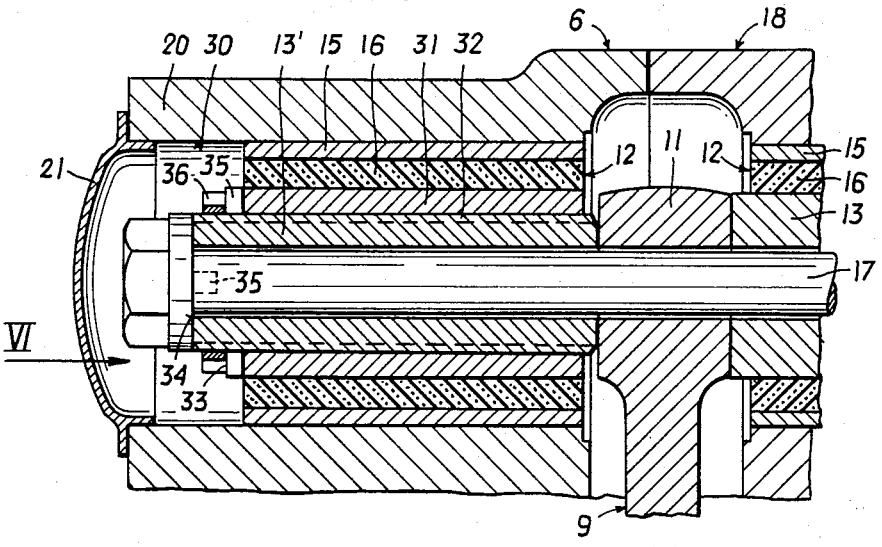
FIG. 5 presents another example according to the present invention, the view corresponding to that of FIG. 4.

In order to simplify this fixing of the relative angular position between the inner sleeve 13' and the intermediary sleeve 31, the variant shown in FIG. 5, e.g., provides a locknut 36 which secures the desired relative position between inner sleeve 13' and outer sleeve 15, once it has been established. For the rest, the variant according to FIG. 5 is identical to that of FIG. 4; identical parts have been given the same reference numbers.

Figure 6:
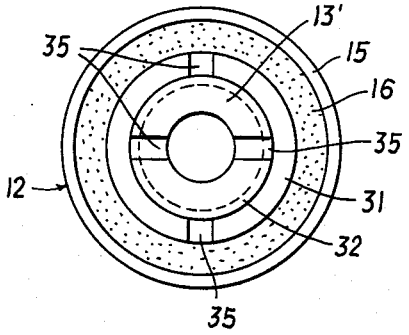
FIG. 6 is a view of the sound-insulating element from FIG. 5 as seen in the direction of arrow VI in FIG. 5.

In FIG. 6 a front view of the sound-insulating element 12 is given; between the outer sleeve 15 and the intermediary sleeve 31 is placed the flexible element 16 which prevents the propagation of structure-borne sound between the outer sleeve 15 and the intermediary sleeve 31. The inner sleeve 13' is guided in the intermediary sleeve 31 by means of the internal thread 32 as described above, in a rotatable and thereby axially movable manner, the grooves 35 for inserting a turning tool being shown.

Figure 7:
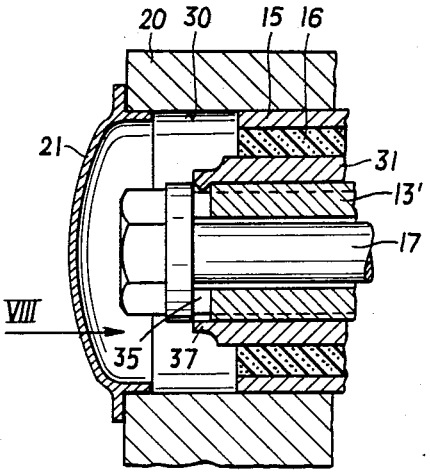
FIG. 7 shows a detail of another embodiment of the present invention, the view again corresponding to that of FIG. 4.
Figure 8:
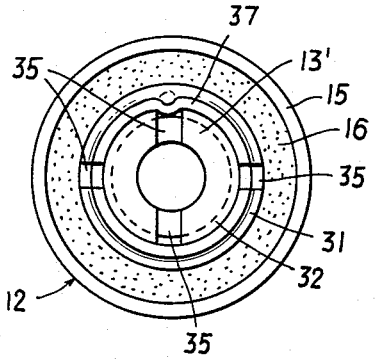
FIG. 8 is a view of the sound-insulating element from FIG. 7 as seen in the direction of arrows VIII in FIG. 7.

The variant presented in FIGS. 7 and 8 differs from that of FIGS. 4 to 6 only in so far as the intermediary sleeve 31 is provided with a thinned-out edge 37 which may be locally pressed into one of the grooves 35 of the inner sleeve 13', as shown in FIG. 8 (top), thus securing in a simple way the relative angular position between inner sleeve 13' and outer sleeve 15, once it has been adjusted as desired.

The variants presented in FIGS. 4 to 8 have in common that the adjustment of the relative axial position of at least some of the sound-insulating elements, which is necessary to guarantee a stress-free mounting of the engine unit support in the crankcase (or a certain desired pre-stressing), may be achieved in a simple manner, without necessitating at least partial repetitions of the mounting process before final assembly.

I claim:

1. An internal combustion engine having an engine unit and an engine unit support, said engine unit comprising such sound-generating parts as cylinders, cylinder head, pistons, piston rods, crankshaft bearings and crankshaft, a crankcase, said support being attached to said crankcase by means of several sound-insulating and force-transmitting elements insulating said crankcase against structure-borne sound, said elements being of substantially hollow cylindrical shape and located outside of an oil-wetted area in said crankcase with their axes being parallel to the axis of said crankshaft, wherein a multi-arm bracket is mounted at least at an output end of said engine unit support for reducing relative movements of said support to swinging movements around said crankshaft axis, said bracket being attached to seats of said crankshaft bearings and being provided with at least one of said sound-insulating elements at an end of each arm thereof, said bracket arms and said sound-insulating elements being positioned symmetrically to said crankshaft axis, and wherein at least some of said sound-insulating elements are provided with inner sleeves coaxially contained within outer sleeves directly unattached thereto with flexible material therebetween, said inner sleeves comprising setting elements being axially adjustable to a position relative to said outer sleeves when said engine unit support has been mounted in said crankcase so that the position of said setting elements fastened to said bracket arms relative to said crankcase can be adjusted in such a way as to make pre-stressing of said sound-insulating elements completely independent of this position.

2. An internal combustion engine according to claim 1, wherein said multi-arm bracket is a two-armed lever.

3. An internal combustion engine according to claim 1, wherein said sound-insulating element comprises a flexible element and an intermediary sleeve carried on said inner sleeve which may be axially moved and adjusted relative to the exterior of said inner sleeve, and which serves as an inner support of said flexible element used for sound-insulation, and which—just as said outer sleeve—is fixedly attached to said flexible element.

4. An internal combustion engine according to claim 3, wherein said inner sleeve is provided with an external thread for engaging said intermediary sleeve.

5. An internal combustion engine according to claim 4, wherein radial grooves are provided on corresponding front faces of said inner sleeve and said intermediary sleeve.

* * * * *

UNITED STATES PATENT OFFICE

CERTIFICATE OF CORRECTION

PATENT NO. : 4,495,908

DATED : January 29, 1985

INVENTOR(S) : Thomas Eidenböck

It is certified that error appears in the above-identified patent and that said Letters Patent are hereby corrected as shown below:

In the title page, correct the assignment information to read --AVL Gesellschaft für Verbrennungskraftmachinen und Messtechnik M.B.H. Prof. Dr. Dr. h.c. Hans List, Graz, Austria--

Signed and Sealed this

*Twenty-sixth* Day of *November 1985*

[SEAL]

*Attest:*

DONALD J. QUIGG

*Attesting Officer*

*Commissioner of Patents and Trademarks*